United States Patent [19]

Salani

[11] 4,342,523

[45] Aug. 3, 1982

[54] HIGH-LOW FORCE AMPLITUDE DEVICE

[75] Inventor: Chittaranjan Salani, Springfield, Ohio

[73] Assignee: Koehring Company, Brookfield, Wis.

[21] Appl. No.: 237,653

[22] Filed: Feb. 24, 1981

[51] Int. Cl.[3] ..... E01C 19/38

[52] U.S. Cl. ..... 404/117; 74/61; 74/87; 366/116

[58] Field of Search ..... 404/117, 113; 74/89, 74/61; 366/116

[56] References Cited

U.S. PATENT DOCUMENTS

| | | | |
|---|---|---|---|
| 2,989,869 | 6/1961 | Hanggi | 74/87 X |
| 3,145,631 | 8/1964 | Green | 404/117 |
| 3,606,796 | 9/1971 | Pappers | 404/117 |
| 3,822,604 | 7/1974 | Grimmer | 74/87 |
| 3,909,147 | 9/1975 | Takata | 404/117 |

FOREIGN PATENT DOCUMENTS

| | | | |
|---|---|---|---|
| 525770 | 3/1977 | U.S.S.R. | 404/117 |

*Primary Examiner*—Nile C. Byers, Jr.

*Attorney, Agent, or Firm*—Burns, Doane, Swecker & Mathis

[57] ABSTRACT

A vibratory compacting roller includes a rotatable compacting roll, and a motor driven vibrator. The vibrator includes a shaft, a movable mass rotatable with the shaft and adjustable transversely thereof, and a position regulator for regulating the position of the mass to provide for a variable amplitude of vibration, the amplitude of vibration of the vibrator being lowest when the center of gravity of the mass is nearest the shaft and greatest when the center of gravity of the mass is farthest from the shaft. The position regulator comprises a spring which automatically positions the eccentric mass to the low amplitude position when the shaft is at rest, whereby minimal start-up torque is imposed upon the motor. A releaseable locking mechanism locks the mass in the low-amplitude position.

8 Claims, 3 Drawing Figures

HIGH-LOW FORCE AMPLITUDE DEVICE

BACKGROUND AND OBJECTS OF THE INVENTION

This invention relates generally to vibratory rollers used in leveling paved or unpaved ground surfaces and more particularly, to a vibratory mechanism for use therein.

In the past, vibratory rollers have been provided with vibrators which include a motor-driven shaft carrying an eccentric mass. Usually, the eccentric mass is adjustable between a plurality of discrete radial positions in order to vary the amplitude of vibration. Generally, the vibratory mechanism is started with the mass disposed in the same position relative to the shaft which is occupied at earlier shut-down. As a result, the motor of the vibratory mechanism must be large to be capable of handling the potentially great start-up loads, especially in cases where the mass is situated in the high-amplitude position at start-up.

It is, therefore, an object of the present invention to reduce the required size of the motor for the vibratory mechanism.

It is another object of the invention to assure that minimal start-up loads are imposed by the eccentric mass.

It is a further object of the invention to assure that the mass is automatically positioned and locked in a low-amplitude setting when the vibratory mechanism is shut-down.

It is a further object of the invention that the vibratory shaft can be rotated in either direction at any amplitude setting without affecting the amplitude thereby allowing to reverse rotation of the eccentric weight. Thus rotation of the eccentric weight may be made opposite to that of drum for better compaction.

SUMMARY OF THE INVENTION

These objects are achieved by the present invention which involves a vibratory compacting roller apparatus of the type including a rotatable compacting roll and a vibrator operably connected to the roller to vibrate the latter. The vibrator includes a shaft rotatable relative to the roller and a motor for rating the shaft. A movable eccentric mass is rotatable with the shaft and is adjustable transversely thereof. A position regulator regulates the position of the mass to provide for a variable amplitude of vibration produced by the vibrator. The amplitude of vibration of the vibrator is lowest when the center of gravity of the mass is nearest the shaft and greatest when the center of gravity of the mass is farthest from the shaft. The position regulator automatically positions the eccentric mass to the low amplitude position when the shaft is at rest whereby minimal start-up torque is imposed upon the motor.

Preferably, the position regulator comprises a yieldable biasing spring for urging the eccentric mass radially inwardly towards the shaft.

Preferably, the position regulator also comprises a releasable locking mechanism for locking the mass in the lowamplitude position.

BRIEF DESCRIPTION OF THE DRAWINGS

A preferred embodiment of the invention is described in the following detailed description in connection with the accompanying drawings in which like numerals designate like elements and in which.

DETAILED DESCRIPTION OF A PREFERRED EMBODIMENT OF THE INVENTION

Figure 1:
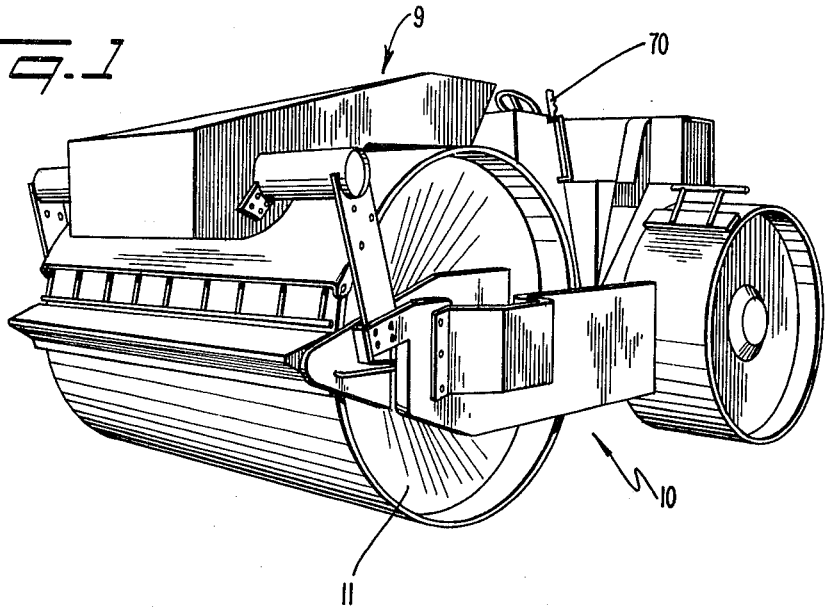
FIG. 1 is a perspective view of a road roller which embodies the present invention.

A ground compacting road roller 9 according to the present invention comprises at least one roller drum 11 rotatably mounted on a wheeled vehicle 10 for rotation about a horizontal axis 15 in a conventional manner.

A vibration mechanism is provided for vibrating the roller and includes a shaft assembly 28. The shaft assembly 28 comprises a first end portion 30 rotatably mounted in a bearing 32 carried by the roller drum 11, a second end portion 34 rotatably mounted in a bearing 36 also carried by the roller drum 11 and a center portion 38 interconnecting the first and second end portions 30 and 34. The shaft assembly 28 is rotatably driven via conventional gears by a motor (not shown) as disclosed in U.S. Application Ser. No. 6/237596 of the present inventor and Gary Jackson, entitled "Vibratory Roller" filed concurrently herewith, the disclosure of which is hereby incorporated by reference.

The center portion 38 has a pair of flanges 40 which extend radially outwardly. The flanges 40 define a radially fixed eccentric mass which creates eccentric vibrating forces when the shaft rotates.

Mounted on the center portion 38 of the shaft assembly 28 is a radially movable mass 44 which is displaceable radially relative to the axis of rotation 15 of the shaft assembly 28. The movable mass 44 includes a first part 46 slidably disposed in the space 42, a second part 48 disposed on the opposite side of the shaft 28, and a connecting bar 50 slidable in a through bore 52 of the center portion 38 of the shaft assembly 28.

The center of gravity of the movable mass 46, 48, 50 is on the same side of the shaft 28 as the part 46. Thus, with the first part 46 of the movable mass disposed in a radially inward position, the center of gravity of the mass 46, 48, 50 is nearest the shaft 28 and the vibration mechanism is in a low amplitude mode. When the first part 46 moves radially outwardly, the amplitude of vibration increases.

A coil compression spring 54 is operably disposed between the center portion 38 of shaft assembly 28 and a lower surface 56 of the second part 48 of the eccentric mass 44. The second part 48 is secured to the bar 50 by a nut 58 tightened on a threaded end portion 60 of the bar 50. The spring 54 is surrounded by a stop collar 62 which is mounted on the center portion 38 of the shaft assembly 28. The spring 54 is compressed when the part 46 shifts radially outwardly under the influence of centrifugal force.

A control rod 64 is slidably mounted within a through bore 66 in the shaft assembly 28, and can be inserted into a through-bore 68 in the bar 50 of the movable mass 44 to lock the mass 40 in the low amplitude position.

The rod 64 can be displaced axially inwardly or outwardly by means of an actuating lever 70 at the operator's station, thereby enabling the mass 44 to be selectively locked in the low amplitude position or unlocked for centrifugally-induced displacement.

Figure 2:
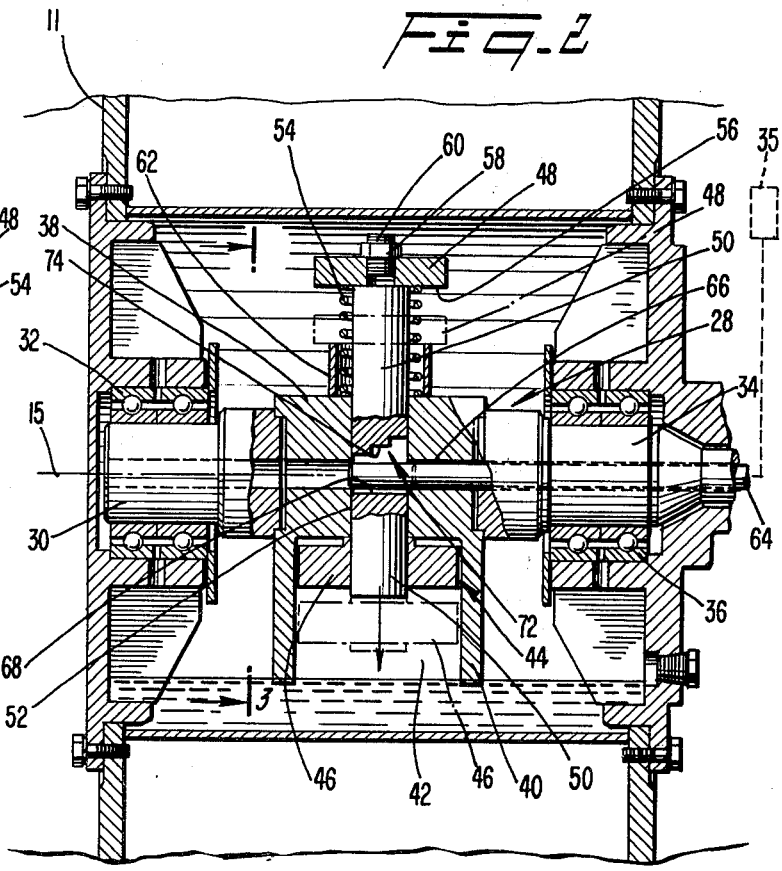
FIG. 2 is a longitudinal of the roller assembly including the vibrator.
Figure 3:
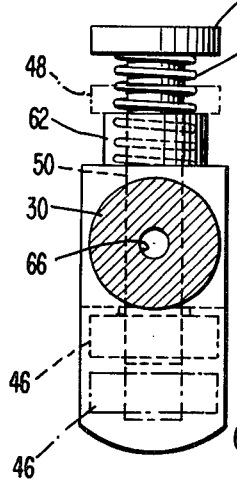
FIG. 3 is a side view of the center portion of the vibratory shaft shown in FIG. 2 along line 3—3.

In operation, the vibration mechanism assumes the low-amplitude position depicted in solid lines in FIG. 2 when in a rest condition due to the action of the spring 54. Thus, during start-up, only relatively small eccentric inertia forces need be overcome by the motor 35. The second part 48 of the mass 44 acts as a counter-weight in the low-amplitude position, to counter the weights of the first part 46 and the fixed weight 40. The mass 44 can be held in the low-amplitude position by the rod 64 until it is desired to increase the amplitude of vibration.

When it is desired to increase the amplitude of vibration, the operator actuates the lever 70 in order to pull the rod 64 from the through bore 68 in the eccentric mass 44. Thereupon, centrifugal force propels the first part 46 of the eccentric mass 44 radially away from the center portion 38 of the shaft assembly 28 until the second part 48 of the movable mass 44 contacts the stop collar 62, whereby the vibratory mechanism is in a high amplitude condition.

When the vibrating mechanism is deactivated and comes to rest, the spring 54 returns the second part 46 of the mass 44 in a radially inward direction, whereupon the control rod 64 can be reinserted into the eccentric mass 44.

It will be appreciated that the amplitudes of vibration of the shaft assembly 28 can be varied by changing the construction of the center portion 38 as well as by altering the size or weight distribution of the eccentric mass 40.

Additional amplitudes of vibration, intermediate the high and low settings, can be provided, for example, by forming a stepped recess 72 in the bar 50 of the eccentric mass 40 (FIG. 2). The stepped recess cooperates with the rod 64 to establish intermediate amplitudes of vibration. That is, by pulling the rod 64 so that the rod aligns with a first step 74 of the recess 72, a first intermediate position can be reached by the mass 44, and so on. Any number of steps can be provided.

It should now be apparent to those skilled in the art that there has been provided in accordance with this invention, an improved vibratory roller. Moreover, it will be apparent to those skilled in the art that numerous modifications, variations, substitutions and equivalents exist for features of the invention without departing from the spirit and scope thereof. Accordingly, it is expressly intended that all such modifications, variations, substitutions and equivalents which fall within the spirit and scope of the invention as defined in the appended claims be embraced thereby.

What is claimed is:

1. In a vibratory compacting roller apparatus of the type including a rotatable compacting roll, vibrator means operably connected to said roll to vibrate the latter, said vibrator means including a shaft rotatable relative to said roll, a motor for rotating said shaft, a movable eccentric mass rotatable with the shaft and adjustable transversely thereof, and position regulating means for regulating the position of said mass to provide for variable amplitude of vibration produced by said vibrator means, the improvement wherein said position regulating means comprises yieldable biasing means acting upon said movable mass for automatically positioning the movable mass radially inwardly to the low-amplitude position when the shaft is at rest whereby minimal start-up torque is imposed upon the motor, and releasable locking means for retaining said movable mass in said low-amplitude position.

2. Apparatus according to claim 1, wherein said movable mass is movable radially outwardly toward a high-amplitude position under the urging of centrifugal force when said locking means is released.

3. Apparatus according to claim 2, wherein said locking means comprises a manually actuable control rod slidably insertable within a through-bore in said movable mass to lock said adjustable mass in said low-amplitude position.

4. Apparatus according to class 3, wherein said through-bore includes a stepped recess with which said control rod may be radially aligned to define intermediate amplitudes of vibration.

5. Apparatus according to claim 4, wherein said shaft includes radially projecting flanges defining a fixed eccentric mass, said movable mass including a first part slidably disposed between said flanges, a second part disposed on the opposite side of said shaft, and a bar interconnecting said first and second parts.

6. Apparatus according to claim 5, wherein said position regulating means comprises a compression spring acting on said second part.

7. Apparatus according to claim 1, wherein said shaft includes radially projecting flanges defining a fixed eccentric mass, said movable mass including a first part slidably disposed between said flanges, a second part disposed on the opposite side of said shaft, and a bar interconnecting said first and second parts.

8. A method of regulating the position of a movable mass of a vibratory mechanism on a vibratory compacting roller, comprising the steps of:

actuating a motor to rotate a shaft to which said mass is adjustably mounted so that centrifugal forces urge said mass away from a low-amplitude position of said vibratory mechanism, preventing said mass from movement away from said low-amplitude position during start-up of said vibratory mechanism and thereafter releasing said mass, and applying yieldable biasing forces to said mass which yield against centrifugal force to enable said mass to travel outwardly toward a high-amplitude position of said vibratory mechanism, and which return said mass to said low-amplitude position of said vibratory mechanism when said shaft is at rest, whereby subsequent start-up torque is minimized.

* * * * *